United States Patent [19]

Tani

[11] 4,288,973

[45] Sep. 15, 1981

[54] MACHINE FOR PRODUCING CHENILLE YARN

[75] Inventor: Fedora Tani, Florence, Italy

[73] Assignee: Chenil Cont GS S.R.L.

[21] Appl. No.: 65,711

[22] Filed: Aug. 10, 1979

[51] Int. Cl.[3] ..... D02G 3/42

[52] U.S. Cl. ..... 57/24; 57/203; 57/206

[58] Field of Search ..... 57/24, 203, 206, 207

[56] References Cited

U.S. PATENT DOCUMENTS

| | | | |
|---|---|---|---|
| 1,514,787 | 11/1924 | Protz | 57/24 X |
| 3,626,679 | 12/1971 | Schwartz | 57/24 |
| 3,645,078 | 2/1972 | Roberts | 57/24 |
| 3,777,464 | 12/1973 | Gross | 57/24 |
| 3,969,881 | 7/1976 | Boldrini | 57/24 |

*Primary Examiner*—John Petrakes
*Attorney, Agent, or Firm*—McGlew and Tuttle

[57] ABSTRACT

A machine for producing chenille yarn has a winding member on which turns of effect yarn are formed. A rotating disc-shaped cutter can be moved into an operative position to cut the turns on the winding member into individual lengths of effect yarn for forming conventional chenille yarn. The cutter can also be moved to a non-operative position remote from the winding member whereby the turns of effect yarn are uncut and the chenille yarn then produced is of the boucle type. The cutter may be moved between its operative and inoperative positions during operation of the machine so that the yarn produced has alternate chenille portions and boucle portions.

5 Claims, 9 Drawing Figures

MACHINE FOR PRODUCING CHENILLE YARN

FIELD OF THE INVENTION

The present invention relates to machines for producing chenille yarns.

SUMMARY OF THE INVENTION

According to the present invention, there is provided in a machine for producing chenille yarn, at least one yarn-forming assembly including means for feeding at least one pair of binding yarns and at least one effect yarn, a winding member, means for forming turns of the effect yarn on the winding member, cutter means, and means for moving the cutter means towards and away from said winding member in order to cut the turns of effect yarn when the cutter is moved towards the winding member, and to leave them intact when it is moved away from the winding member to provide respectively for the formation of yarn comprising normal chenille portions or boucle portions.

Preferably, the winding member comprises a longitudinal slot in which the cutter means is located in its operative position.

This machine may have a plurality of aligned yarn-forming assemblies with cutter means which are movable cyclically under the control of a cylinder-piston servo motor or the like. Each cutter means comprises a disc-shaped blade with means for rotating it and which is moved towards and away from the respective winding member.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
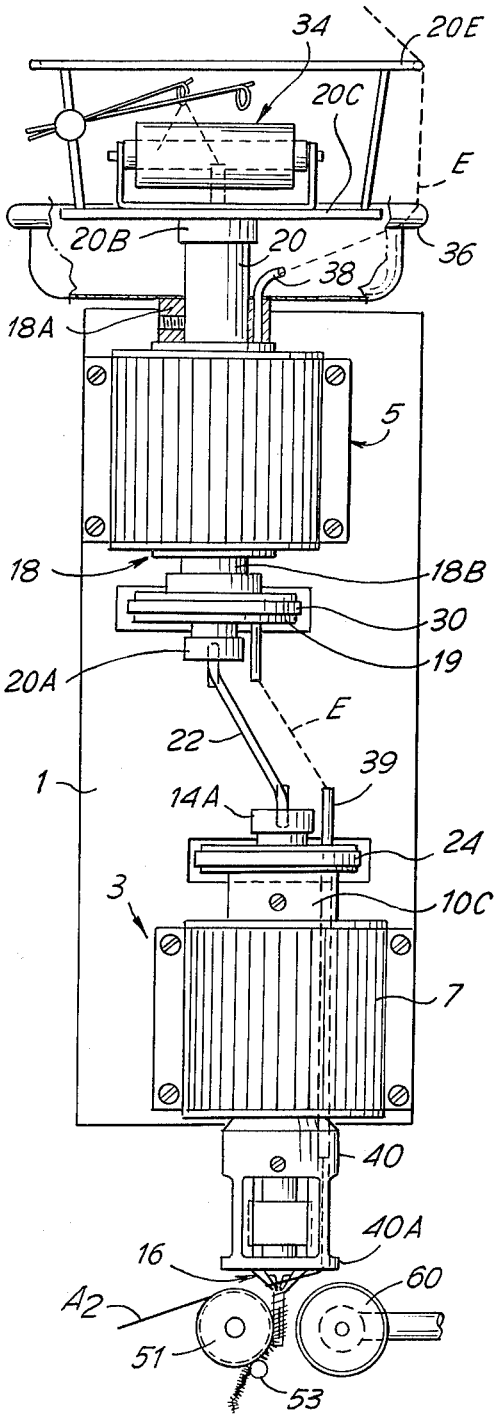
FIG. 1 is a fragmentary front elevation of a yarn-forming assembly in a machine for producing chenille yarn.

The machine shown in the accompanying drawings comprises a support structure 1 on which are mounted two assemblies 3 and 5 which are disposed in mutually offset relation. The assembly 3 (FIG. 2) comprises an external casing 7 supported by the structure 1 and containing bearings 9 which mount a rotor 10 which can rotate about the axis of the assembly. A core 14 is mounted inside the rotor 10 by bearings 12. The core 14 has an upper extension which projects from the upper end of the casing 7 to carry an upper head 14A and a lower extension 14B, to which a winding member 16 is fitted. An effect yarn E is wound around a triangular part of the winding member 16 as will be described later and this determines the size of individual lengths of effect yarn or of boucle loops. The winding member 16 is preferably replaceable to permit changes in size.

The assembly 5 is similar to the assembly 3 and comprises a rotor equivalent to the rotor 10, carrying at its upper end 18A a yarn guide 36 and at its lower end 18B a pulley 19. Inside the rotor 18 there is mounted a core 20 corresponding to the core 14, and having projecting lower and upper end portions 20A and 20B, respectively, which can be seen in FIG. 1. The core is mounted so that it can rotate about an axis which is offset relative to the axis of the core 14. The two cores are connected rigidly together by a pair of profiled bars 22.

Although each core is rotatably mounted within the assembly 3 or 5, the connection provided by the bars 22 between the two cores prevents their rotation due to the interaction between the cores. In contrast, the two rotors 10 and 18 can rotate, and are in fact rotated synchronously. For this purpose, the rotor 10 comprises a toothed pulley 10C, about which is wound a toothed belt 24 driven from a shaft which also drives a second toothed belt 30 wound about the pulley 19 fixed to the rotor 18. The two rotors 10 and 18 therefore rotate at the same speed, and support the two cores 14 and 20 but without causing rotation of the cores. The two cores 14 and 20 are therefore prevented from rotating without having any external connection to a fixed part.

On the upper end portion 20B of the core 20 there is disposed a platform 20C which carries spools 34 of binding or core yarn A. The core yarns which are unwound from the spools 34 pass through longitudinal bores in the cores 20 and 14 to reach the winding member 16 mounted at the lower end of the core 14. The platform 20C also carries a ring 20E, along which slides a free span of effect yarn E fed from an overlying fixed spool. After passing through a ring yarn guide 36, the effect yarn E passes through a guide tube 38 contained in the rotor 18, to emerge below this rotor and then pass into a tube 39 mounted on the rotor 10. The tube 39 opens into an annular cage 40, having a lower ring 40A which forms a yarn guide rotatable around the winding member 16 to wind the effect yarn E. The effect yarn E describes a circular trajectory outside the assemblies 3 and 5, inside the tubes 38 and 39, inside the cage 40 and around the winding member 16 without any interference with the stationary cores 14, 20, which are located within the trajectory described by the effect yarn.

There may be only a single effect yarn E, or several effect yarns fed in an analogous manner simultaneously via the same tube.

The winding member 16 mounted at the lower end of the stationary core 14 comprises a base 41 traversed by two bores 43, one of which receives a core yarn A from one of the spools 34. The yarn A emerges from the base 41 and is fed to a yarn guide 45 fitted against a triangular winding plate 47, connected to the base 41, which has an extension plate 49 having a portion centrally extending through the winding plate and a portion extending therefrom provided with a longitudinal slot 49B to receive a cutting blade when the chenille portion is to be formed, as will be described hereinafter.

The winding member 16 is associated with means for feeding an external core yarn A2, which passes round a roller 51 to the side of the extension 49 of the triangular plate 47.

To provide improved guiding and entrainment of the effect yarn E which may be sheared into individual lengths, a backing roller 53 lies against the roller 51, and is driven thereby.

The core yarn A from a spool 34 is drawn through the axial bores in the two cores 20 and 14, and then through the bore 43 in the winding member 16, to reach the yarn guide 45 and thus pass on to the roller 51. The effect yarn E is fed around the triangular plate 47 of the winding member 16 from the yarn guide formed by the ring 40A, so as to form turns as the rotor 10 rotates, with consequent rotation of the cage and ring 40,40A. These turns become gradually tightened and slide along the edges of the plate 47 to form tight turns on its extension 49. In this manner, turns or coils of effect yarn are formed, as indicated at E1.

Figure 6:
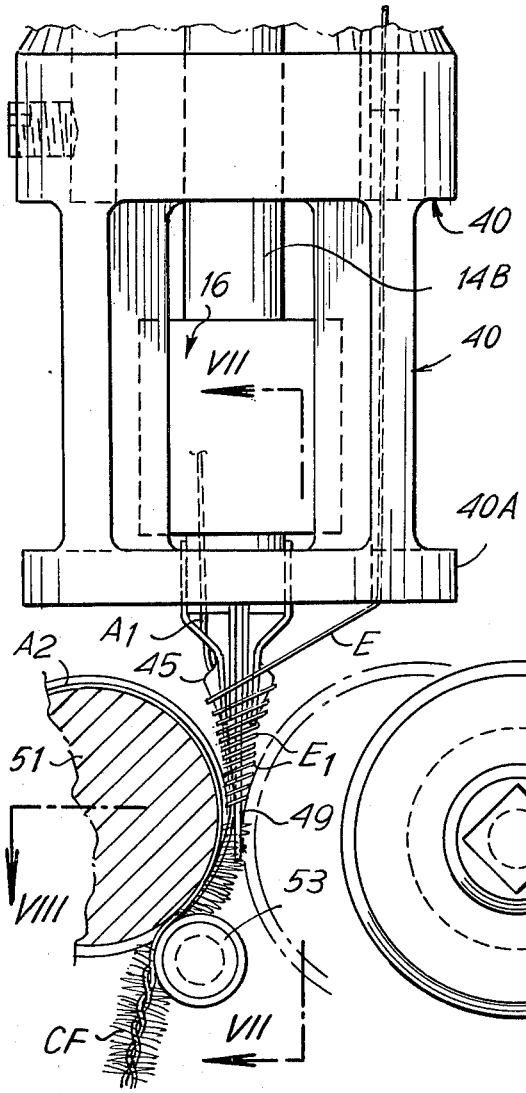
FIG. 6 is a view similar to FIG. 4, but showing the operation when the blade has been moved out of its active position.
Figure 6:
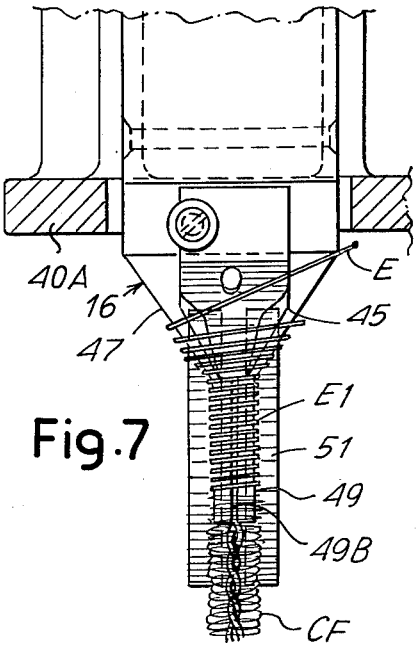
Figure 7:
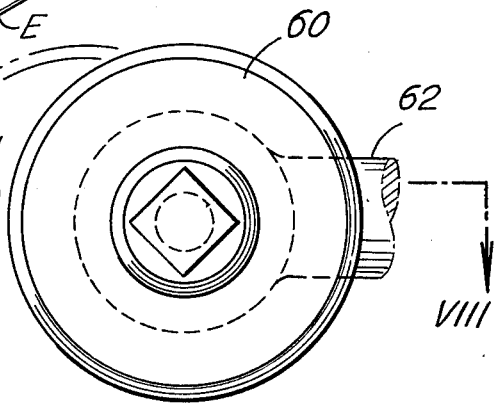
FIGS. 7 and 8 are sections taken respectively on lines VII—VII and VIII—VIII of FIG. 6.
Figure 8:
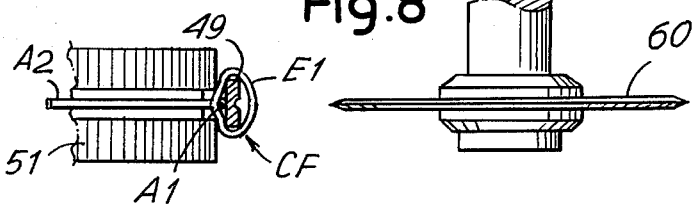

This arrangement gives a fancy yarn of the so-called boucle or flocked chenille type CF, i.e. with uncut coils of effect yarn, as shown in FIGS. 6, 7, and 8. The turns leave the winding member 16 below the end of the extension 49.

Figures 2, 3, 9:
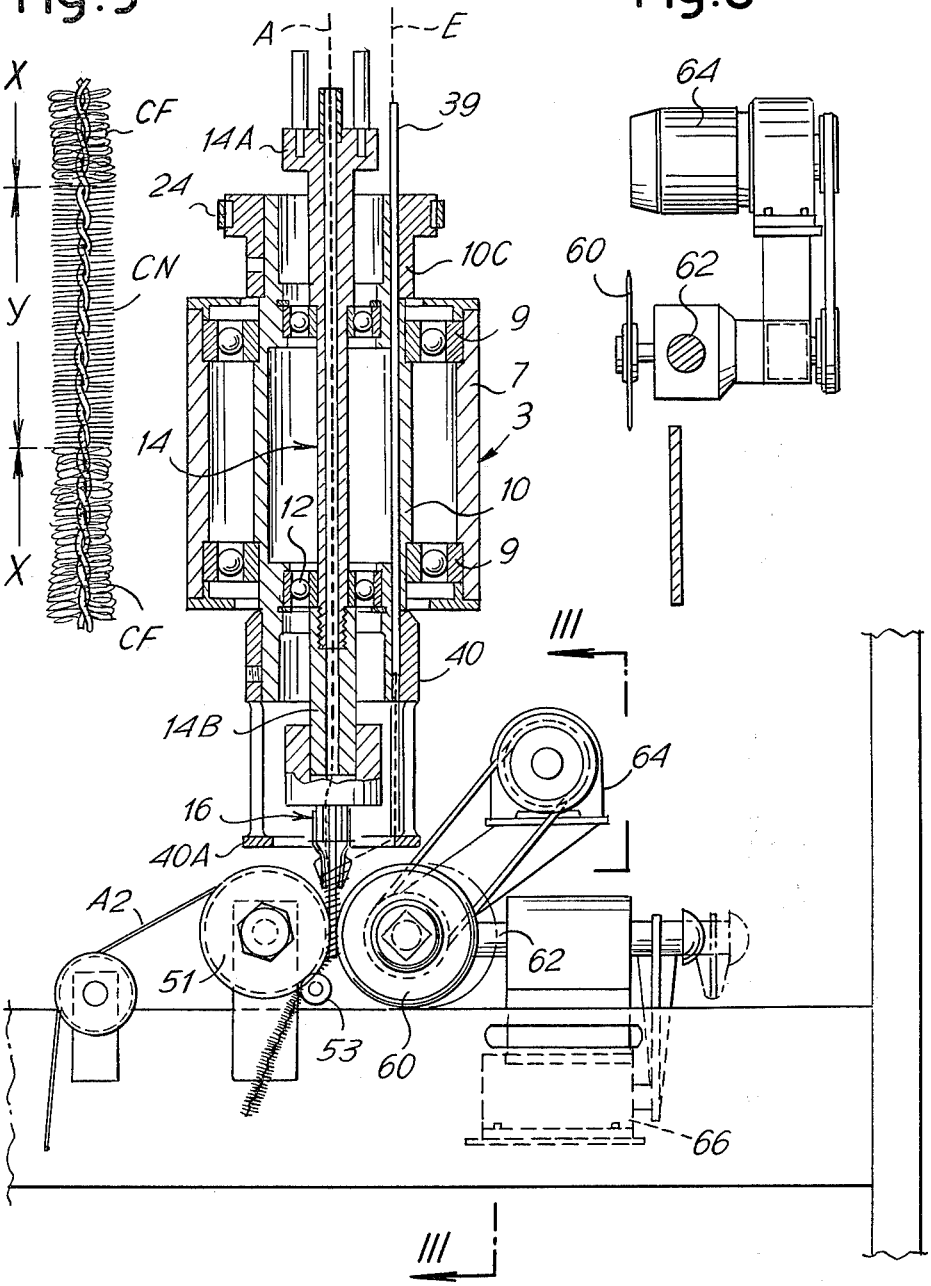
FIG. 2 is a section to an enlarged scale of a detail of FIG. 1.
FIG. 3 is a section taken on line III—III of FIG. 2.
FIG. 9 shows a length of fancy yarn produced by the machine.
Figure 4:
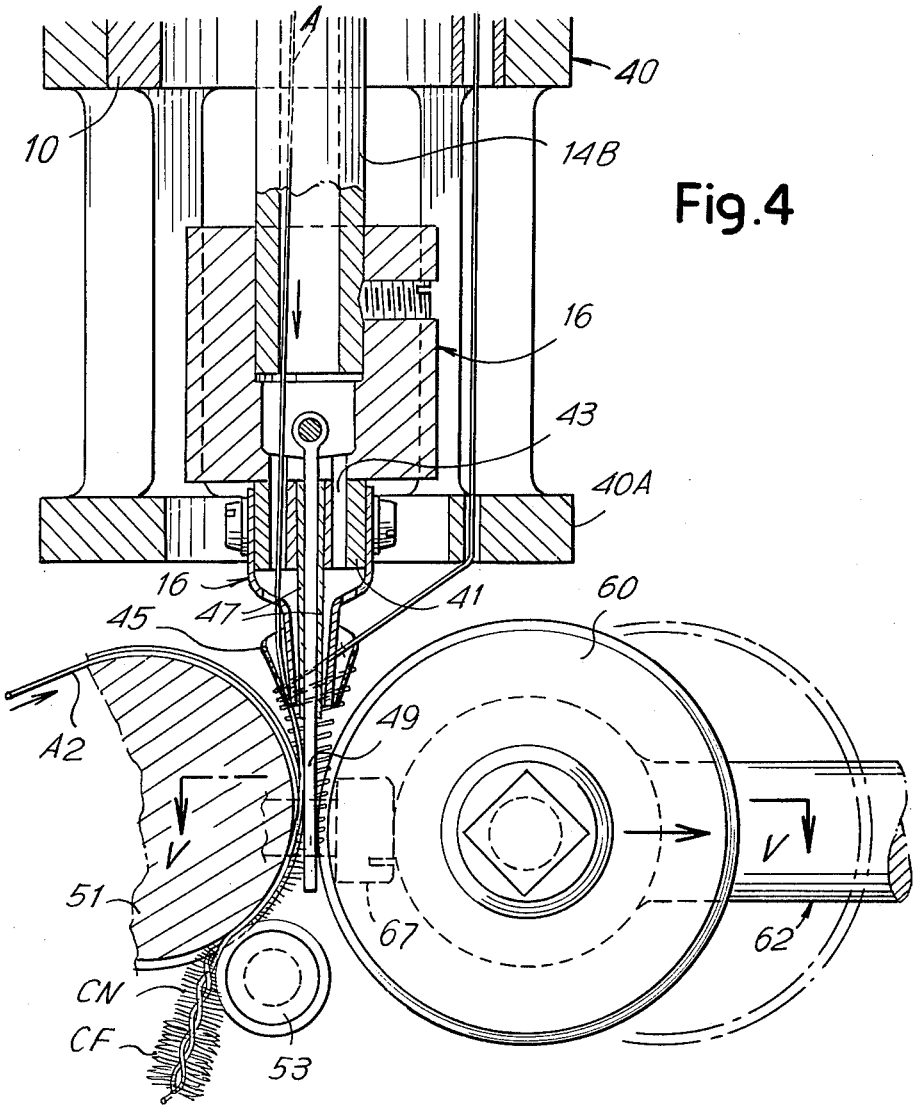
FIGS. 4 and 5 are, respectively, an enlarged detail of FIG. 2, and a section of line V—V of FIG. 4, illustrating the operation when a cutting blade is in its active position.
Figure 5:
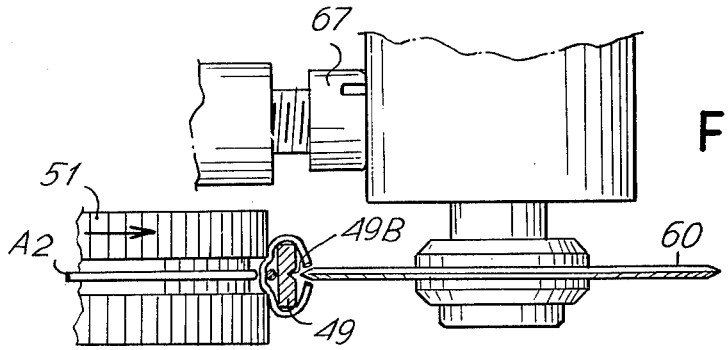

The machine is also equipped to produce a special fancy yarn as shown in FIG. 9. This yarn comprises portions X of flocked chenille (boucle), produced in the aforesaid manner, interspaced with portions Y of normal chenille CN, i.e. with individual sheared lengths of effect yarn. This is obtained by providing a cutting blade with is made periodically active and inactive. For this purpose a rotatable disc-shaped blade 60 mounted on a movable support 62 on which there is also mounted a motor 64 for driving the blade 60. The support 62 is preferably mounted for rectilinear sliding movement and is controlled by a cylinder 66, which can displace the support 62 between an inactive position in which the blade 60 is remote from the member 16 (FIGS. 6 and 8) and an active position in which the blade 60 enters the narrow slot **49*b* provided longitudinally in the surface of the extension 49 opposite the feed roller 51 for the core yarn A2 (FIGS. 4 and 5). This position can be determined by an adjustable stop 67. In its active position the blade 60 cuts a plurality of successive turns E1, so that instead of forming successive loops of flocked chenille CF, cut lengths of effect yarn are formed, to constitute the portions Y of normal chenille CN (FIG. 9). Each blade 60 is advantageously protected by a suitable guard. The operation of the blade 60** can be program controlled to provide any required alternation between the portions X and Y. In practice the machine will be provided with several yarn-forming assemblies as described above, with the blades of the respective assemblies being controlled by the same program so that identical yarn will be produced by each assembly.

What is claimed is:

1. In a machine for producing chenille yarn, at least one yarn-forming assembly including means for feeding at least one pair of binding yarns and at least one effect yarn, a winding member, means for forming turns of the effect yarn on the winding member, cutter means, and means for moving the cutter means towards and away from said winding member into and out of engagement with the effect yarn at selected intervals as said yarns are fed to said winding member in order to cut the turns of effect yarn when the cutter is moved towards the winding member and to leave them intact when it is moved away from the winding member to provide respectively for the formation of yarn having alternating chenille and boucle portions.

2. A machine as claimed in claim 1, wherein the winding member includes a longitudinal slot, for receiving the cutter means in its operative position.

3. A machine as claimed in claim 1, wherein the cutter means comprises a disc-shaped rotatable blade and means for driving the blade, and the means for moving the cutter means, comprises a movable support carrying the blade and the blade driving means, and means operable to cyclically move the support.

4. In a machine for producing chennile yarn, at least one yarn-forming assembly including a winding member, means for feeding at least one pair of binding yarns and at least one effect yarn to said winding member, means for forming turns of the effect yarn on said winding member, cutter means, and means for moving said cutter means towards and away from said winding member into and out of engagement with the effect yarn at selected intervals as said yarns are fed to said winding member in order to cut a plurality of successive turns of effect yarn when said cutter means is moved towards the winding member and to leave a plurality of successive turns of effect yarn intact when said cutter means is moved away from said winding member to form, respectively, yarn having alternating chenille and boucle portions.

5. A machine as claimed in claim 4, wherein said winding member includes a base, a winding plate connected to said base having a longitudinally tapering surface coaxially disposed about a portion of said base about which the effect yarn is circularly passed for successively forming said turns of effect yarn, said base having a bore extending therethrough for guiding a binding yarn centrally of the successive turns of effect yarn, and an extension plate having a portion centrally extending through said winding plate and a portion extending therefrom having a longitudinal slot for receiving said cutter means when said cutter means is moved towards said winding member to cut a plurality of successive turns of effect yarn.

* * * * *